US006801335B2

(12) United States Patent
Del Signore et al.

(10) Patent No.: US 6,801,335 B2
(45) Date of Patent: Oct. 5, 2004

(54) METHOD OF CONTROLLING IMPACT PRINTER NOISE

(75) Inventors: James Del Signore, Trumansburg, NY (US); Steven Spano, Ithaca, NY (US)

(73) Assignee: Axiohm Transaction Solutions, Inc., Ithaca, NY (US)

( * ) Notice: Subject to any disclaimer, the term of this patent is extended or adjusted under 35 U.S.C. 154(b) by 268 days.

(21) Appl. No.: 09/740,657

(22) Filed: Dec. 20, 2000

(65) Prior Publication Data

US 2002/0176728 A1 Nov. 28, 2002

(51) Int. Cl.[7] ..... B41J 7/92

(52) U.S. Cl. ..... 358/1.8; 400/124.11; 400/124.18; 400/131; 400/166; 400/124.05

(58) Field of Search ..... 358/1.1–1.9, 1.11–1.18; 101/46, 47, 93.02–93.05, 93.15, 93.18, 93.28, 93.29, 93.42, 93.48; 400/124.11, 124.05, 124.14–124.23, 131, 138.1, 157.2, 157.3, 166, 167; 178/4, 23 R

(56) References Cited

U.S. PATENT DOCUMENTS

| | | | | | |
|---|---|---|---|---|---|
| 4,074,067 | A | * | 2/1978 | Speckhard | 400/551 |
| 4,333,398 | A | * | 6/1982 | Carson, Jr. et al. | 400/166 |
| 4,351,618 | A | * | 9/1982 | Prewarski | 400/166 |
| 4,743,821 | A | * | 5/1988 | Hall | 318/599 |
| 6,043,676 | A | * | 3/2000 | Mendel et al. | 326/39 |

* cited by examiner

*Primary Examiner*—King Y. Poon
(74) *Attorney, Agent, or Firm*—George R. McGuire; Bond, Schoeneck & King, PLLC

(57) ABSTRACT

A method of controlling noise in an impact printer that modulates the input pulse to the power amplifier of the printer. The resulting current waveform is then applied to the print wire solenoids. The final shape of the force input to the platen reduces or spreads the spectral envelope containing problem harmonics and acoustic output noise.

6 Claims, 2 Drawing Sheets

METHOD OF CONTROLLING IMPACT PRINTER NOISE

FIELD OF THE INVENTION

The present invention relates to impact printers and, more particularly, to a method of controlling impact printer noise.

BACKGROUND OF THE INVENTION

A typical test system for evaluating radiated acoustic noise problems comprises a forcing function, whose content is characterized in the frequency domain by a spectral signature, a transfer function that modifies the spectral content of the forcing function, and a radiator that is driven by the output of the forcing function. The radiator converts the mechanical energy to acoustic energy. The final frequency content of the output acoustic energy impinging upon the ear of an operator is a result of the radiator dynamics and acoustic impedance of the medium through which the sound pressure waves travel.

Noise control of acoustic energy heard by the human ear can be accomplished by modifying one of the aforementioned three test system elements.

In real systems comprising retail and financial impact printers, the total acoustic noise generating system is more complex than described hereinabove. Elements of printer acoustic systems have multiple force inputs, such as stepper motors, print heads, and solenoids. Many transfer functions are defined by platens, carriage shafts, mechanical connections, etc. These transfer functional components create a multiplicity of cross coupled, vibration pathways, through which mechanical vibrations can reach the radiators. The primary radiators of the commercial impact printers manufactured by the present assignee usually become the cabinet and the receipt, journal, or slip paper that is printed. In assignee's printer systems, control of acoustic noise can be accomplished by making changes to the matrix of any one of the aforesaid system elements.

Unfortunately, noise control techniques are usually applied to these commercial printers after the fact. This results in expensive and unsuitable methods of damping or attenuating acoustic borne noise. The acoustic noise leaks out of the openings in the cabinet or emanates directly off of the cabinet surfaces.

Other noise reducing methods have been tried that modify the transfer functions involved in the system. Typically, these include rubber isolators, massive platens, or appropriately designed and placed damping materials. These solutions tend to be expensive, ineffective, and undesirable.

The present inventors of assignee, Axiohm Corporation of Ithaca, N.Y., have discovered that modifying basic forcing function inputs results in more effective control of the final printer acoustic noise output.

In assignee's impact printers, such as model nos. 7150, 7221, and A758, the primary system input forcing function comprises the impact print head wires that strike the platen. Time domain force cell measurements have shown the shape of the input forcing function is triangular or saw toothed. In actual operation, the forcing function becomes repetitive at 900 to 1000 Hz. Amplitude of this function depends on the number of dots being fired during a single impact time.

This waveform can be spectrally viewed as the convolution of a single finite energy triangular waveform with a comb function. The impulses of the waveform are separated in the time domain by the repetition rate period (trep). The resulting spectrum creates an envelope defined by the finite energy triangular waveform with harmonics inside that envelope spaced at 1/trep.

In scrutinizing this spectral view, it can be concluded that changing the shape or nature of the basic print head force input waveform can affect the entire acoustic output of the printer system.

Previous print head control electronics were limited in their ability to wave shape the input voltage pulses due to the inability of the main control processor to perform this function. Also, the cost of implementing specific electronic hardware circuits to perform this function was prohibitive. Recently, however, the cost of higher performance microcontrollers has been reduced.

Also, the invention reflects the fact that printer controllers can include Complex Programmable Logic Devices (CPLDS) or Field Programmable Gate Arrays (FPGAS), wherein impact force wave shaping can be accomplished more easily.

SUMMARY OF THE INVENTION

In accordance with the present invention, there is provided a method of controlling impact printer noise. The method changes the shape or nature of the basic print head force input waveform that affects the entire acoustic output of the printer system. Previous print head control electronics were limited in their ability to wave shape the input voltage pulses due to the inability of the main control processor to perform this function. Also, the cost of implementing specific electronic hardware circuits to perform this function was prohibitive. The method of the invention modulates the input pulse to the power amplifier. The resulting current waveform is then applied to the print wire solenoids. The final shape of the force input to the platen reduces or spreads the spectral envelope containing problem harmonics and acoustic output noise.

It is an object of this invention to provide an improved method of controlling impact printer noise.

It is another object of the invention to provide a method of modulating and/or shaping the input voltage and solenoid winding current of an impact printer in order to modify the impact force.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a method of controlling noise in an impact printer. The method of the invention modulates the input pulse to the power amplifier of the printer. The resulting current waveform is then applied to the print wire solenoids. The final shape of the force input to the platen reduces or spreads the spectral envelope containing problem harmonics and acoustic output noise.

Figure 1:
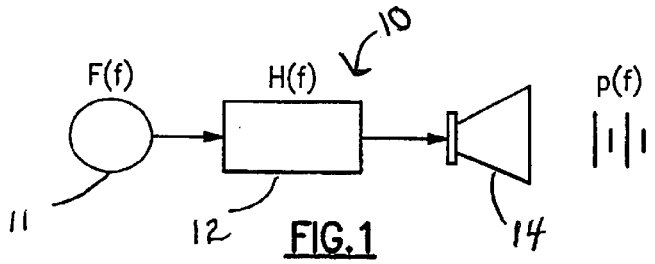
FIG. 1 illustrates a schematic diagram of a typical noise evaluating system.

Now referring to FIG. 1, a typical system 10 is shown for evaluating radiated acoustic noise problems. The system 10 comprises: (1) a forcing function 11, whose content is characterized in the frequency domain by a spectral signature; (2) a transfer function 12 that modifies the spectral content of the forcing function 11 and provides an output that drives (3) a radiator 14 that converts mechanical energy to acoustic energy.

Noise control of acoustic energy heard by the human ear can be accomplished by modifying one of the three elements 11, 12, or 14, respectively. The final frequency content of the output acoustic energy impinging upon the ear of an operator is a result of the radiator dynamics and acoustic impedance of the medium through which the sound pressure waves travel.

In real systems comprising retail and financial impact printers, the total acoustic noise generating system is rather complex. Elements of printer acoustic systems have multiple force inputs, such as stepper motors, print heads, and solenoids. Many transfer functions are defined by platens, carriage shafts, mechanical connections, etc. These transfer functional components create a multiplicity of cross coupled, vibration pathways, through which mechanical vibrations can reach the radiators. The primary radiators of commercial impact printers manufactured by the present assignee usually become the cabinet and the receipt, journal, or slip paper that is printed. In assignee's printer systems, control of acoustic noise can be accomplished by making changes to the matrix of any one of the aforesaid system elements.

Unfortunately noise control techniques are usually applied to these commercial printers after the fact. This results in expensive and unsuitable methods of damping or attenuating acoustic borne noise. The acoustic noise leaks out of the openings in the cabinet or emanates directly off of the cabinet surfaces.

Other noise reducing methods have been tried that modify the transfer functions involved in the system. Typically, these include rubber isolators, massive platens, or appropriately designed and placed damping materials. These solutions tend to be expensive, ineffective, and undesirable.

The present invention reflects the discovery that modifying basic forcing function inputs results in more effective control of the final printer acoustic noise output.

In assignee's impact printers, such as model nos. 7150, 7221, and A758, the primary system input forcing function comprises the impact print head wires that strike the platen. Time domain force cell measurements have shown the shape of the input forcing function is triangular or saw toothed. In actual operation, the forcing function becomes repetitive at 900 to 1000 Hz. Amplitude of this function depends on the number of dots being fired during a single impact time.

Figure 2:
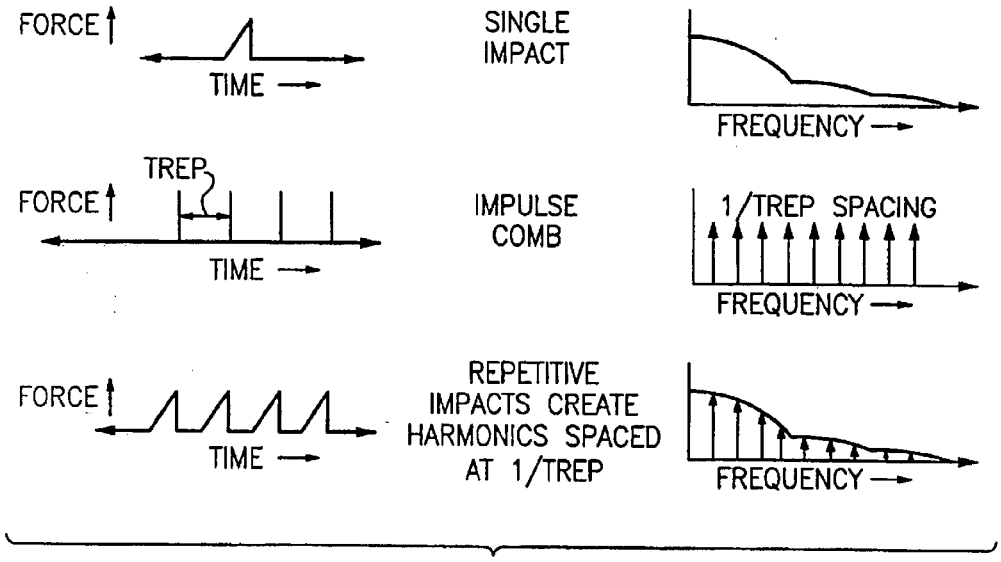
FIG. 2 depicts a diagram of force and waveform with harmonics, whose impulses are separated at 1/trep.

Referring to FIG. 2, this waveform can be spectrally viewed as the convolution of a single finite energy triangular waveform with a comb function. The impulses of the waveform are separated in the time domain by the repetition rate period (trep). The resulting spectrum creates an envelope defined by the finite energy triangular waveform with harmonics inside that envelope spaced at 1/trep.

In scrutinizing this spectral view, it can be concluded that changing the shape or nature of the basic print head force input waveform can affect the entire acoustic output of the printer system.

Figure 3:
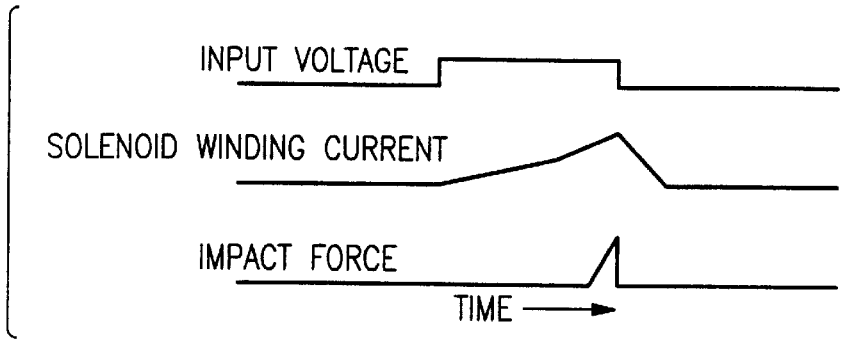
FIG. 3 shows a set of diagrams depicting how impact force is created.

Referring to FIG. 3, diagrams depict how the impact force is created. Typically, a logic level voltage pulse is applied to a power amplifier circuit which causes a print wire solenoid current to rise and create electromotive force that accelerates the wire until it impacts the platen.

Figure 4:
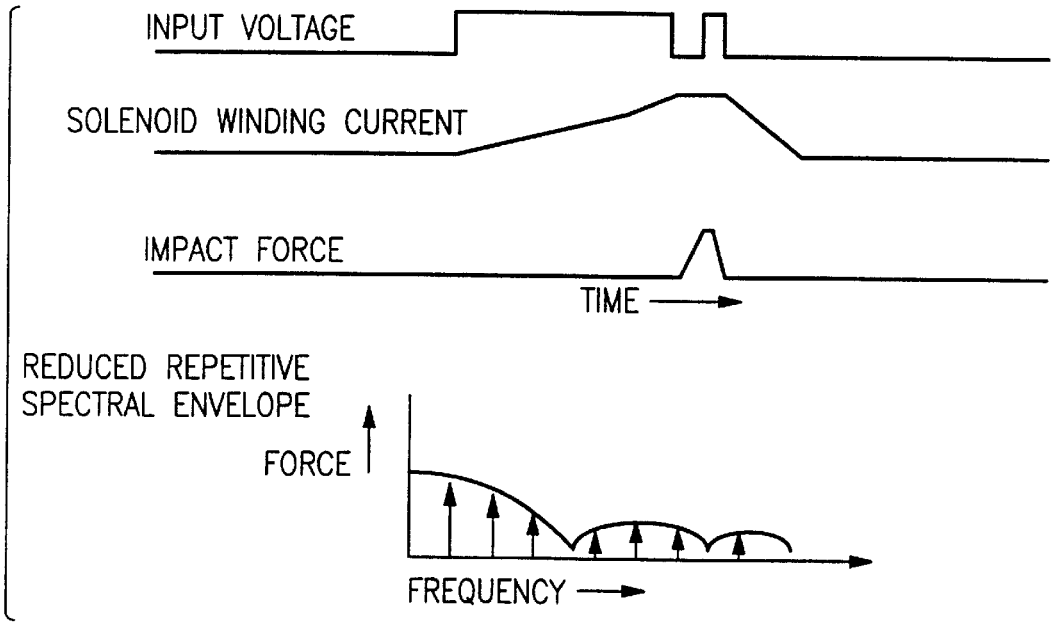
FIG. 4 illustrates diagrams of how an input voltage pulse to a power amplifier could be modulated to provide a current waveform that is applied to print wire solenoids in order to shape the force input to the impact printer platen, and hence the printer acoustic output noise.

It is possible that the input pulse to the power amplifier could be modulated as suggested in FIG. 4. The resulting current waveform applied to print wire solenoids and final shape of the force input to the platen could then reduce or spread the spectral envelope containing problem harmonics and consequent final printer acoustic output noise.

Previous print head control electronics were limited in their ability to wave shape the input voltage pulses due to the inability of the main control processor to perform this function. Also, the cost of implementing specific electronic hardware circuits to perform this function was prohibitive. Recently, however, the cost of higher performance microcontrollers has been reduced.

Also, the scope of the invention includes printer controllers having CPLDS or FPGAS, wherein impact force wave shaping can be more easily accomplished.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of controlling noise in an impact printer, comprising the steps of:

a) generating at least two distinct positive input pulses of voltage and applying them to a power amplifier of the impact printer, whereby a solenoid winding current waveform is created; and b) applying said solenoid winding current waveform to print wire solenoids to create a single force having a reduced repetitive spectral envelope containing problem harmonics.

2. The method of controlling noise in an impact printer in accordance with claim 1, further comprising the step of modulating said input pulses.

3. The method of controlling noise in an impact printer in accordance with claim 1, further comprises the step of shaping said input pulses.

4. A system for controlling noise in an impact printer, comprising:

a print wire solenoid;

a power amplifier for supplying power to said print wire solenoid;

means for generating at least two distinct positive input pulses of voltage and applying them to said power amplifier, whereby a solenoid winding current waveform is created; and means for transmitting said solenoid winding current waveform to said print wire solenoids to create a single force having a reduced repetitive spectral envelope containing problem harmonics.

5. The system in accordance with claim 4, further including a Complex Programmable Logic Device (CPLD).

6. The system in accordance with claim 4, further including a Field Programmable Gate Array (FPGA).

* * * * *